US006307621B1

(12) United States Patent
Endo et al.

(10) Patent No.: US 6,307,621 B1
(45) Date of Patent: Oct. 23, 2001

(54) PAPER FEED APPARATUS

(75) Inventors: Koji Endo; Makoto Yoshikawa; Kazuo Watanabe, all of Utsunomiya (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/713,203

(22) Filed: Nov. 16, 2000

(30) Foreign Application Priority Data

Dec. 13, 1999 (JP) ..... 11-353263

(51) Int. Cl.[7] ..... G03B 27/00; B41J 2/01; B41J 2/41; B41J 2/385; G01D 15/24

(52) U.S. Cl. ..... 355/407; 347/104; 347/105; 347/153; 346/134

(58) Field of Search ..... 355/407; 347/152, 347/153, 104; 346/134

(56) References Cited

U.S. PATENT DOCUMENTS 6,104,508 8/2000 Miyazaki .

FOREIGN PATENT DOCUMENTS 2-57846 4/1990 (JP) .

*Primary Examiner*—Russell Adams
*Assistant Examiner*—Khaled Brown
(74) *Attorney, Agent, or Firm*—Greenblum & Bernstein, P.L.C.

(57) ABSTRACT

The present invention provides pivot 207*a* of paper edge regulation element 207 that evens up the edges of placed sheets aside from rotation axis 206 of pickup roller 204, forms groove 208 into which rotation axis 206 that has ascended is fitted in paper edge regulation element 207, makes rotation axis 206 fit into groove 208 of paper edge regulation element 207 when pickup roller 204 is lifted to regulate the rotation of paper edge regulation element 207 and makes rotation axis 206 come off groove 208 of paper edge regulation element 207 and become free to rotate when pickup roller 204 is lowered.

12 Claims, 12 Drawing Sheets

PAPER FEED APPARATUS

BACKGROUND OF THE INVENTION

1. Field of the Invention

The present invention relates to a paper feed apparatus of a copier, etc. that separates and sends out one sheet at a time from a bundle of sheets such as originals or recording paper, and more particularly, to a paper feed apparatus having a paper edge regulation mechanism that evens up the edges of sheets.

2. Description of the Related Art

Conventionally, a paper feed apparatus provided for a copier, etc. is equipped with a paper edge regulation mechanism that evens up the edges of sheets to prevent double-sheet feeding or oblique feeding, during feeding of sheets of paper placed.

A conventional paper edge regulation mechanism evens up the edges of sheets placed by moving up and down a paper edge regulation element for evening up the edges of sheets using a solenoid. When paper is placed, this paper edge regulation mechanism lifts the paper edge regulation element, makes the edges of sheets contact the paper edge regulation element and evens up the edges of sheets. On the other hand, when paper is fed, this paper edge regulation mechanism lowers the paper edge regulation element, makes the paper edge regulation element detach from the edges of sheets and at the same time lowers a pickup roller, makes it contact the upper surface of paper, rotates the pickup roller and sends out paper to a feeding roller.

However, the paper edge regulation mechanism above has an ascending/descending mechanism that moves up and down the paper edge regulation element and an ascending/descending mechanism that moves up and down the pickup roller as independent mechanisms, which produces a problem of having a complicated apparatus configuration. Moreover, it is necessary to secure a space for installing these complicated mechanisms in the apparatus, which is an obstacle to miniaturization of the apparatus. Furthermore, it is also necessary to synchronize the ascending/descending timing of the paper edge regulation mechanism with the ascending/descending timing of the pickup roller. However, the paper edge regulation mechanism and pickup roller are operated by the two different ascending/descending mechanisms. For this reason, it is necessary to accurately control the timing and this adjustment is complicated.

Therefore, a technique of mechanically linking the timing at which the paper edge regulation element contacts the edges of sheets with the ascending/descending timing of the pickup roller is proposed. The Utility Model Publication No.HEI 2-57846 discloses a paper feed apparatus, which mechanically links the timing at which the paper edge regulation element contacts the edges of sheets with the ascending/descending timing of the pickup roller.

FIG. 16A and 16B show a configuration of the paper feed apparatus described in the above Publication. Paper edge positioning element 3 is attached to rotation axis 5 of pickup roller 4 in a pivotable manner. This makes paper edge positioning element 3 ascend or descend in synchronization with the ascent or descent of pickup roller 4. Moreover, first protrusion 3*a* and second protrusion 3*b* are formed on paper edge positioning element 3 extending in different directions. When pickup roller 4 is in a position above paper 2, first protrusion 3*a* evens up the edges of sheets 2 and second protrusion 3*b* touches stopper 6. In this state, even if paper 2 presses first protrusion 3*a*, second protrusion 3*b* touches stopper 6 and the rotation of paper edge positioning element 3 itself is regulated. In this way, first protrusion 3*a* remains stationary with the edges of sheets contacting and acts so as to even up the edges of sheets. On the other hand, when pickup roller 4 descends until pickup roller 4 touches paper 2, second protrusion 3*b* separates from stopper 6, first protrusion 3*a* is pressed by paper 2 and paper edge positioning element 3 itself rotates. As a result, first protrusion 3*a* moves up to a position where first protrusion 3*a* does not block feeding of paper 2.

The feeding apparatus above eliminates the need to move up or down the paper edge regulation element using independent mechanisms, making it possible to save space. Moreover, paper edge positioning element 3 ascends or descends, while being held in a pivotable manner to the rotation axis of pickup roller 4. This ensures synchronization between the ascending/descending timing of paper edge positioning element 3 and the ascending/descending timing of pickup roller 4.

However, the above paper feed apparatus described in the Publication has the following problem:

That is, in the above paper feed apparatus, when pickup roller 4 ascends, paper edge positioning element 3 also ascends and second protrusion 3*b* touches stopper 6. As a result, even if paper 2 pushes first protrusion 3*a*, the rotation of paper edge positioning element 3 is regulated. In this case, when paper 2 is strongly pressed to first protrusion 3, the rotation of paper edge positioning element 3 itself is regulated by contact between second protrusion 3*b* and stopper 6. Thus, second protrusion 3*b* is strongly pressed to stopper 6. In this case, as the pressing force to this second protrusion 3*b* increases, frictional force between second protrusion 3*b* and stopper 6 also increases. When pickup roller 4 is lowered in this state, the above frictional force prevents pickup roller 4 from descending smoothly, causing aproblemof blocking paper feeding. Especially, when the location where second protrusion 3*b* touches stopper 6 is above the horizontal position of pivot 5 of pickup roller 4, the track of second protrusion 3*b* moves in the direction in which stopper 6 is pushed. This causes second protrusion 3*b* to be further pushed to stopper 6.

SUMMARY OF THE INVENTION

It is an object of the present invention to provide a paper feed apparatus capable of saving space inside the apparatus, securing synchronization between the ascending/descending timing of the paper edge regulation element and the ascending/descending timing of the pickup roller and smoothly lowering the pickup roller even if paper is strongly pressed to the paper edge regulation element.

The present invention provides a pivot of the paper edge regulation element that evens up the edges of sheets placed aside from the rotation axis of the pickup roller and forms a groove to accommodate the rotation axis of the pickup roller that has ascended so that when the pickup roller is lifted while no paper is fed, the rotation axis of the pickup roller enters into the groove of the paper edge regulation element and regulates the rotation of the paper edge regulation element and when the pickup roller is lowered during paper feeding, the rotation axis of the pickup roller separates from the groove of the paper edge regulation element and becomes free to rotate.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

With reference now to the attached drawings, an embodiment of the present invention will be explained in detail below.

Figure 1:
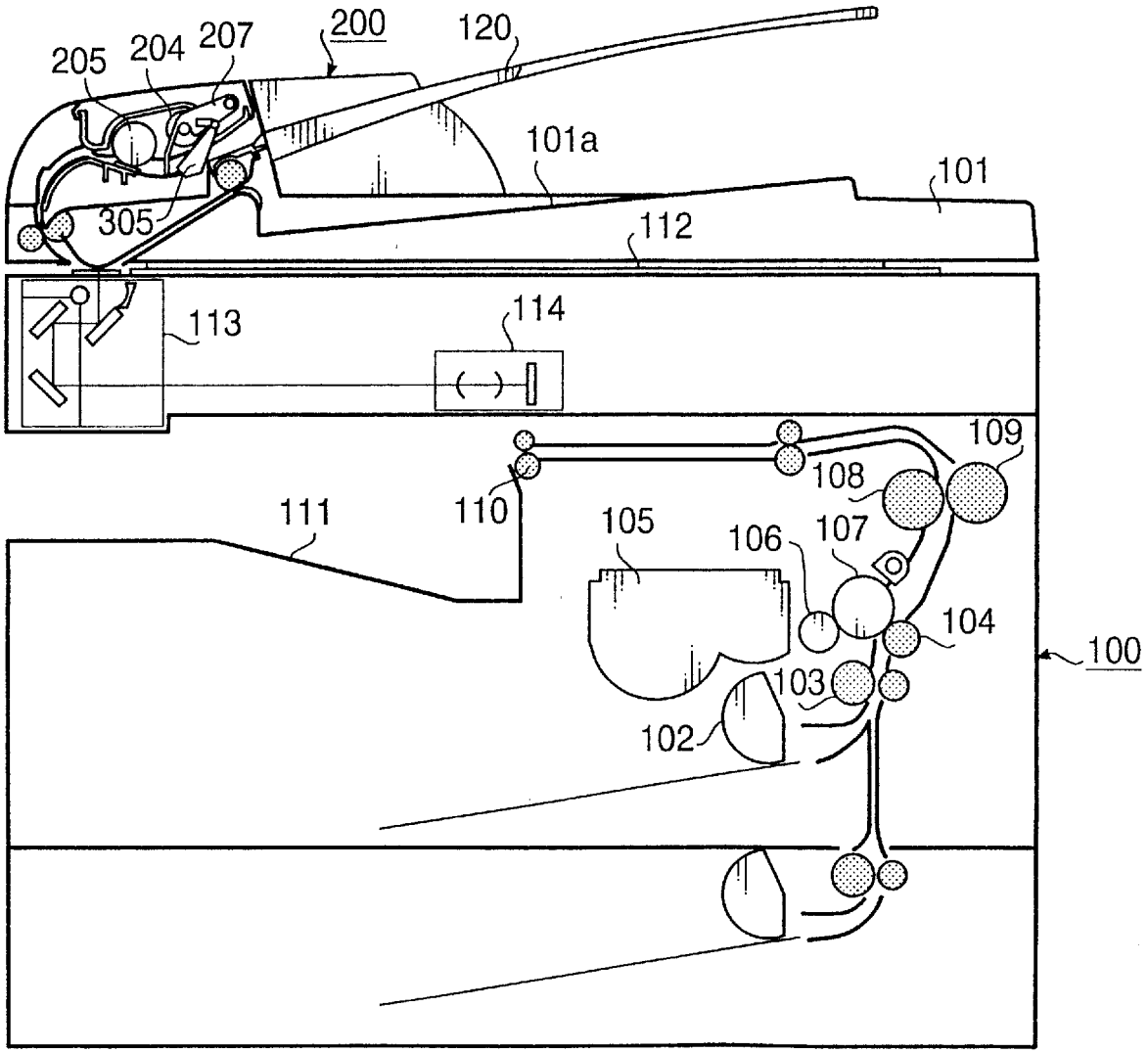
FIG. 1 is an overall configuration diagram of a copier according to an embodiment of the present invention.

FIG. 1 is an overall configuration diagram of a copier according to this embodiment. This copier is provided with copier main unit 100 with a recoding system, opening/closing cover 101 provided on the top surface of copier main unit 100 so that copier main unit 100 can be opened/closed to the copier main unit 100 and covers a surface reading for the original 100 and paper feed apparatus 200 provided on opening/closing cover 101. Before explaining the structure of paper feed apparatus 200, the structure of the recording system of copier main unit 100 will be explained.

In copier main unit 100, a recording sheet set in a paper feed cassette is sent out to register roller 103 by semicircular paper feed roller 102. The recording timing in a transfer unit of the recording sheet sent out to register roller 103 is controlled by register roller 103. Toner in process cartridge 105 is transferred to photosensitive material 107 by development apparatus 106 and the toner is transferred to the recording sheet caught between photosensitive material 107 and transfer roller 104 and in this way an image is formed. The recording sheet, which has passed through the transfer unit is sent to a photographic fixing unit where the image is fixed by fixing roller 108 and pressure roller 109. The recording sheet on which the image is formed in this way is ejected to main unit ejection tray 111 by ejection roller 110.

Platen glass 112 is placed on the top surface of copier main unit 100. Under platen glass 112, optical unit 113 that scans a original image and CCD 114 that subjects the image scanned by optical unit 113 to photo-electric conversion are placed.

Next, the structure of paper feed apparatus 200 will be explained. Paper feed apparatus 200 has paper feed tray 120 protruding diagonally over opening/closing cover 101 in which sheets of paper are placed and separates one sheet at a time from the sheets of paper placed, picks it up, sends it in the opposite direction, lets it pass through a scanning position of platen glass 112 and ejects it to ejection tray 101*a* formed on the top surface of opening/closing cover 101.

Figure 2:
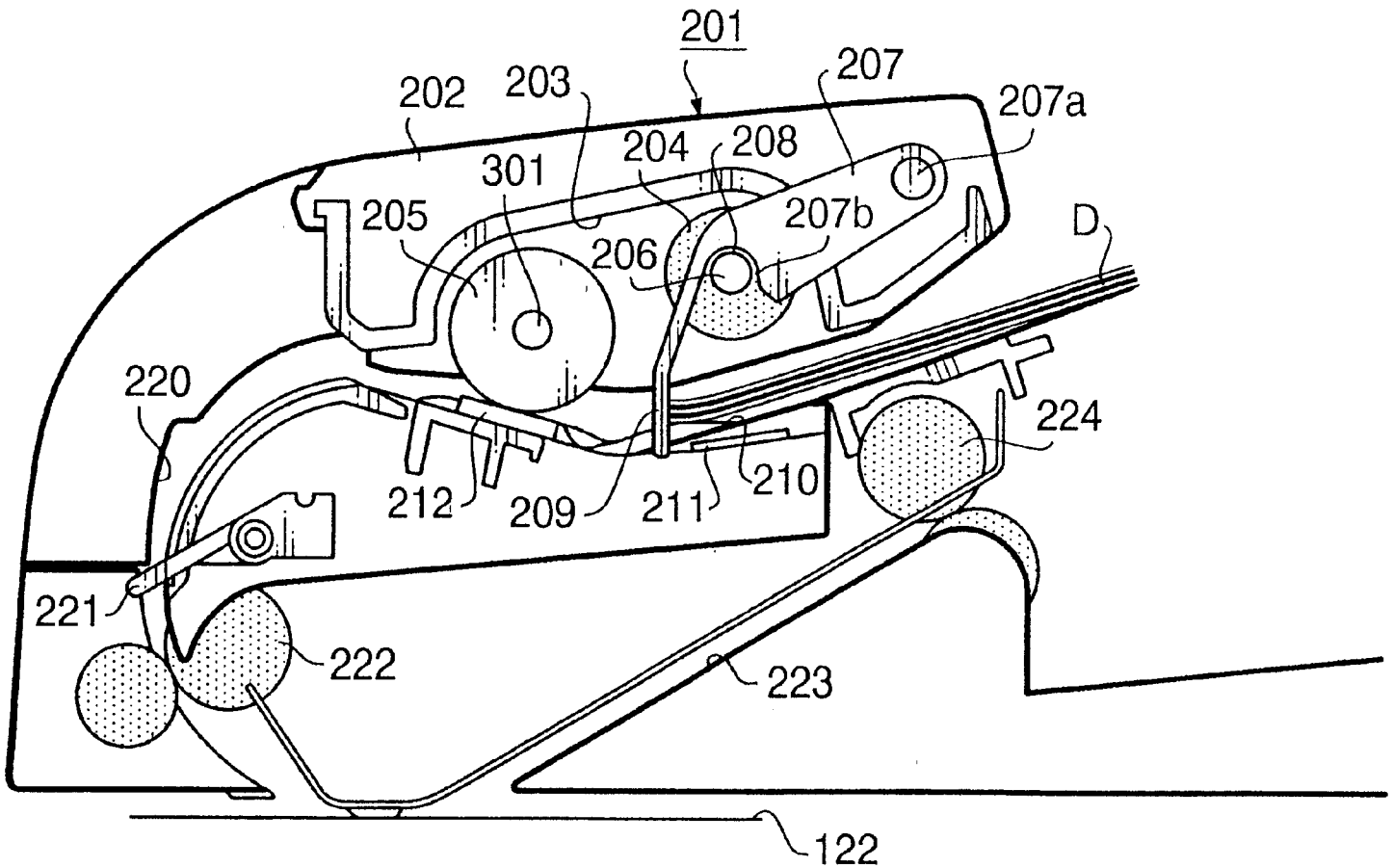
FIG. 2 is a configuration diagram of a paper feed apparatus provided for the copier of the embodiment above.

FIG. 2 is a side view showing the structure of paper feed apparatus 200. Upper paper feed unit 201 is provided over the section of the transport path formed inside paper feed apparatus 200 from the paper feed port to the paper inversion section. Upper paper feed unit 201 is configured by frame 202 and parts such as a paper edge regulation mechanism and roller rotation axis are attached to frame 202. Cavity 203 of a predetermined width is formed on the bottom surface of frame 202. Pickup roller 204 and paper feed roller 205 are placed in such a way as to fit in cavity 203. Rotation axis 206 of pickup roller 204 is attached to a coupling element attached to the rotation axis of paper feed roller 205. Rotation axis 206 of pickup roller 204 descends in synchronization with forward rotation of paper feed roller 205 and ascends when the forward rotation of paper feed roller 205 ends.

A pair of paper edge regulation elements 207 is provided on both sides of pickup roller 204. Paper edge regulation elements 207, which sandwich pickup roller 204, are supported by frame 202 in a pivotable manner centered on pivot 207*a* in front of the rotation axis of paper feed roller 205. Groove 208 is formed in the intermediate part of paper edge regulation element 207 to accommodate rotation axis 206 of pickup roller 204 when pickup roller 204 ascends.

Here, groove 208 fans out from the innermost part that rotation axis 206 of pickup roller 204 touches toward the opening. When pickup roller 204 ascends and rotation axis 206 of pickup roller 204 enters into groove 208, the fan shape of groove 208 allows rotation axis 206 of pickup roller 204 to smoothly enter into groove 208. This can prevent rotation axis 206 of pickup roller 204 from failing to enter into groove 208 and failing to function as a stopper.

Paper regulation lug 209 is formed from the intermediate part to the tip of paper edge regulation element 207. Paper regulation lug 209 has a length enough to reach the surface of the transport path when rotation axis 206 of pickup roller 204 completely fits into groove 208. Furthermore, when the tip of paper regulation lug 209 reaches the surface of the transport path, paper regulation lug 209 becomes almost upright. Sheets of paper placed in paper feed tray 120 are placed inclined with the lead-in side positioned lower to promote smooth paper feeding under their own weight. This means that the upper sheets of paper whose edges are evened up by paper regulation lug 209 are shifted backward, while the lower sheets are shifted forward.

When paper edge regulation element 207 is rotated by a pushing force of the sheets of paper sent out when rotation axis 206 of pickup roller 204 comes off groove 208 of paper edge regulation element 207, this can alleviate load on the sheets of paper compared to a case where paper regulation lug 209 of the paper edge regulation element is placed perpendicular to the surface of the sheets of paper placed. This can avoid cases where the edges of sheets may be folded to rotate paper edge regulation element 207 or an excessive load of torque may cause the motor to stop.

Of the transport path of paper feed apparatus 200, the transport path facing upper paper feed unit 201 is configured as follows. That is, the inclined plane of paper feed tray 120 extends to just before the paper regulation position of paper regulation lug 209 and inclination guide 210 is formed to guide sheets upward just before the paper regulation position. Forming inclination guide 210 to guide sheets upward just before the paper regulation position ensures that the edges of sheets touch paper regulation lug 209. This can prevent sheets of paper from escaping through a gap between the tip of paper regulation lug 209 and the transport path and make paper regulation element 207 fully function as the stopper to even up the edges of sheets of paper placed.

Furthermore, separation pad 211 is provided just before the location where paper regulation lug 209 touches in the area facing pickup roller 204. Separation pad 211 functions to help the pickup roller touch the lowermost sheet so as to pick up the last one sheet without fail.

The transport path facing upper paper feed unit 201 further passes through the paper regulation position and has reverse inclination in front of paper feed roller 205 so as to guide sheets in an upward slanting direction. separation pad 212 is provided in a position of the transport path facing paper feed roller 205. Separation pad 212 functions to separate one sheet at a time from the sheets sent out by pickup roller 204.

Figure 3:
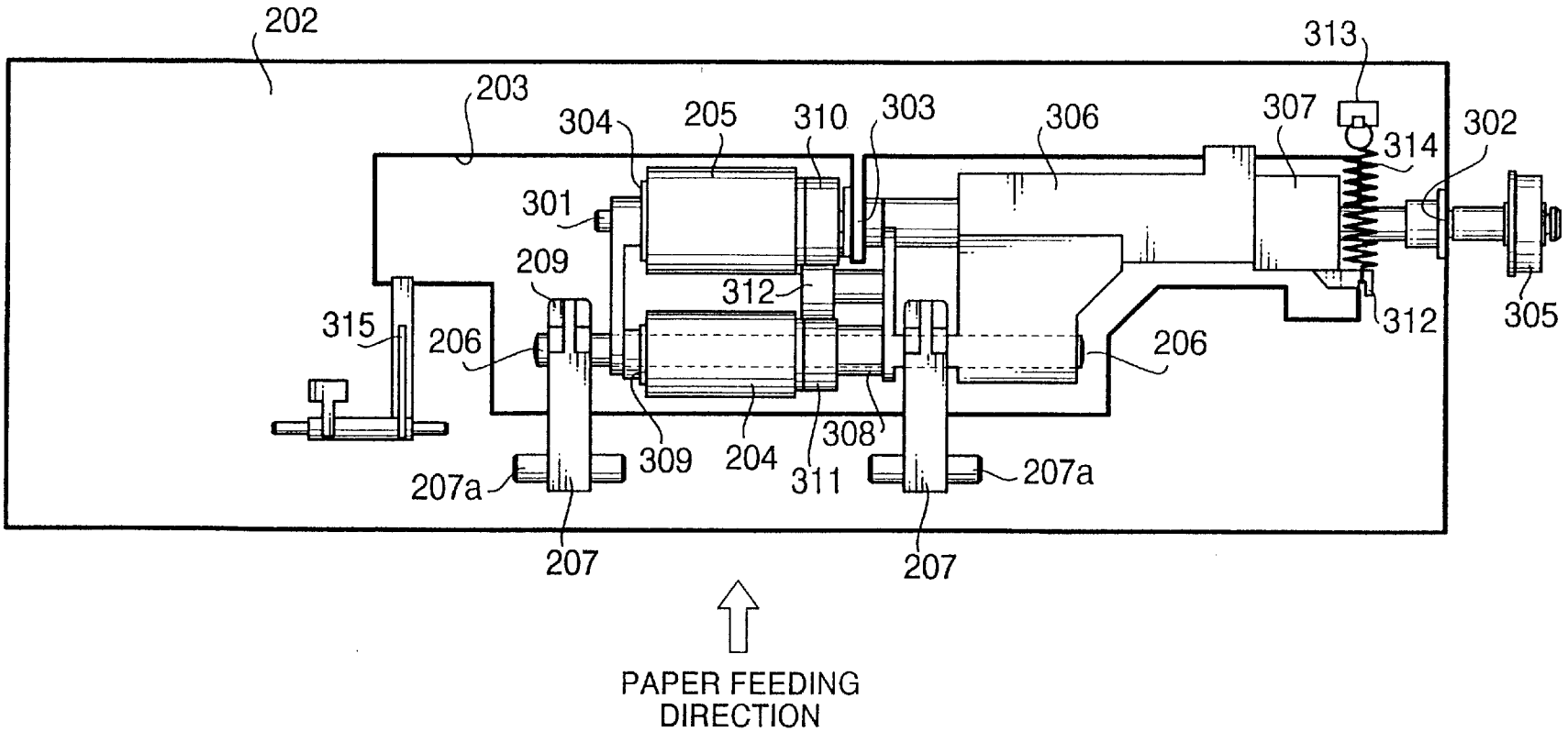
FIG. 3, is a plan view of an upper paper feed unit provided for the paper feed apparatus above.

FIG. 3 is a plan view of upper paper feed unit 201. This figure is a perspective view from the top of upper paper feed unit 201 that shows pickup roller 204, paper feed roller 205 and paper regulation element 207 through frame 202. Rotation axis 301 of paper feed roller 205 is supported by bearings provided on side wall 302 of frame 202 and rib 303 of an intermediate section. Between paper feed roller 205 and rotation axis 301, one-way clutch 304 is provided to lock the reverse rotation of paper feed roller 205 regarding the paper feeding direction as forward rotation. Furthermore, rotation axis 301 of paper feed roller 205 is provided with paper feed roller gear 305 in a section protruding from side wall 302 of frame 202 toward the outside of the unit. A driving force is transmitted to paper feed roller gear 305 from a motor, which will be described later.

Coupling element 306 is connected to rotation axis 301 of paper feed roller 205 via torque limiter 307. Torque limiter 307 gives a predetermined frictional force between rotation axis 301 and coupling element 306. When forward torque is applied to rotation axis 301 of paper feed roller 205, coupling element 306 rotates centered on rotation axis 301 of paper feed roller 205 until the torque exceeds the frictional force above. When the forward torque exceeds the frictional force above, rotation axis 301 of paper feed roller 205 and torque limiter 307 of coupling element 306 slide past each other and rotation axis 301 rotates independently.

Coupling element 306 branches midway and the branched end is provided with bearing 308 to hold rotation axis 206 of pickup roller 204. one-way clutch 309, which locks the reverse rotation regarding the paper feeding direction as forward rotation is provided between pickup roller 204 and rotation axis 206. Furthermore, gear 310 fixed to one end of paper feed roller 205 is linked with gear 311 fixed to one end of pickup roller 204 via intermediate gear 312.

Thus, since rotation axis 206 of pickup roller 204 is linked with rotation axis 301 of paper feed roller 205 via coupling element 306, when coupling element 306 rotates around rotation axis 301 of paper feed roller 205, rotation axis 206 of pickup roller 204 fixed to coupling element 306 also rotates together with coupling element 306 and descends. Also when pickup roller 204 that has descended touches a sheet of paper and regulates the rotation of coupling element 306, one-way clutch 307 slides and only rotation axis 301 of paper feed roller 205 rotates. As a result, pickup roller 204 also rotates forward via gear 310 attached to paper feed roller 205, intermediate gear 312 and gear 311 attached to pickup roller 204.

Restoration coil spring 314 is stretched between protrusion 312 formed on coupling element 306 and protrusion 313 provided on the frame side. Coil spring 314 acts to pull coupling element 306 so that pickup roller 204 ascends and returns to a standby position. When paper feed roller gear 305 is separated from a movable gear, which will be described later, coupling element 306 is pulled back by a restoring force of coil spring 314 and rotation axis 206 of pickup roller 204 ascends.

Placement detection sensor 315 to detect sheets placed in paper feed tray 120 is attached to frame 202. Placement detection sensor 315 is provided next to pickup roller 206 and detects that a sheet has been placed by being kicked by the edge of the sheet placed.

Regarding the transport path of paper feed apparatus 200, semicircular inversion path 220 is formed from the end of upper paper feed unit 201 to the scanning position of platen glass 112. Register sensor 221 to detect passage of sheets is provided in the middle of inversion path 220. In addition, register roller 222 is provided next to register sensor 221. Inclined plane 223 is formed after the scanning position of platen glass 112 to guide sheets upward again and ejection roller 224 is provided at the end of inclined plane 223.

Figure 4A:
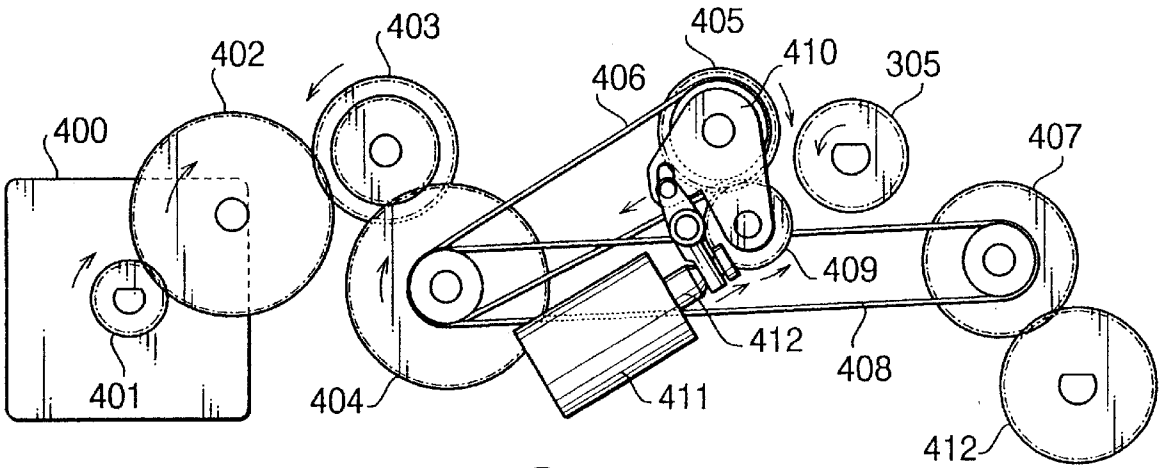
FIG. 4A is a configuration diagram showing a first state of a drive system from a motor to a paper feed roller gear and register roller gear in the paper feed apparatus above.
Figure 4B:
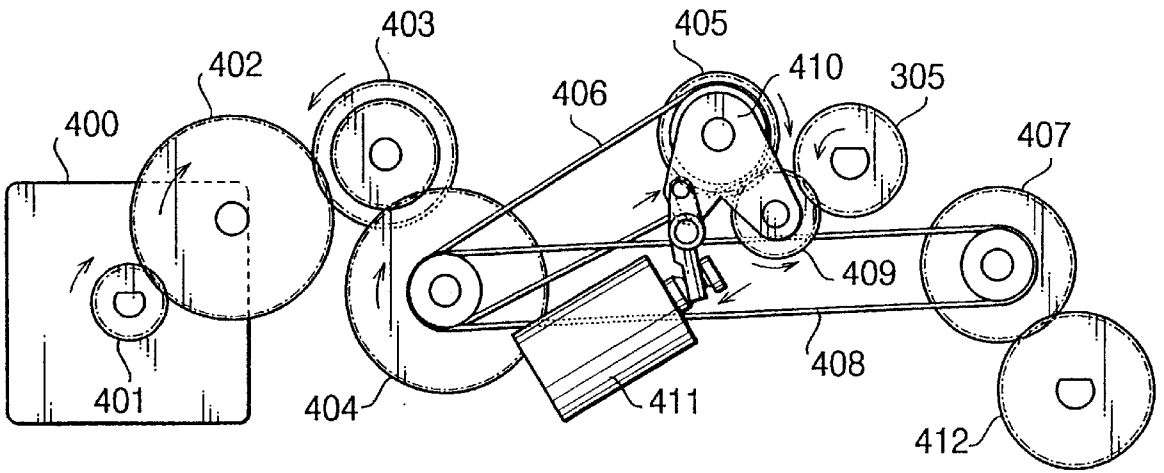
FIG. 4B is a configuration diagram showing a second state of the drive system from the motor to the paper feed roller gear and register roller gear in the paper feed apparatus above.

FIG. 4A and FIG. 4B show the driving force transmission mechanism from a motor as a driving source to a driven section made up of paper feed roller 205 and register roller 222. Intermediate gears 402,403 and 404 are connected in series to motor gear 401 fixed to the rotation axis of motor 400. Transmission belt 406 is put between the rotation axis of intermediate gear 404 and the rotation axis of driving gear 405 on the paper feed roller side. In addition, transmission belt 408 is put between the rotation axis of intermediate gear 404 and the rotation axis of driving gear 407 on the register roller side. Planet gear 409 engages with driving gear 405 on the paper feed roller side. The rotation axis of driving gear 405 and the rotation axis of planet gear 409 are linked by link 410. Link 410 is further linked with the movable part of solenoid 411. When the movable part of solenoid 411 extends or contracts, planet gear 409 goes around driving gear 405. Paper feed roller gear 305 is placed in the orbit of driving gear 405 in which planet gear 409 moves. In this way, when the movable part of solenoid 411 extends, planet gear 409 moves up to paper feed roller gear 305 and engages with paper feed roller gear 305, making it possible to transmit the power of motor 400 to paper feed roller gear 305. On the other hand, when the movable part of solenoid 411 contracts, planet gear 409 is separated from paper feed roller gear 305 making paper feed roller gear 305 free. The timing of coupling or separation between planet gear 409 and paper feed roller gear 305 by solenoid 411 will be explained later.

Driving gear 407 on the register roller side is connected with register roller gear 412. Register roller gear 412 is connected with driving gear 407 via an electromagnetic clutch.

Next, the operation of the copier with the above configuration will be explained centered on paper feed apparatus 200.

FIG. 2 shows a state in which the edges of sheets D placed in paper feed tray 120 are evened up by paper edge regulation element 207. By pickup roller 204 ascending to a standby position, rotation axis 206 of pickup roller 204 fits into groove 208 of paper edge regulation element 207. When sheets D are placed in paper feed tray 120, the edges of sheets D touch paper regulation lug 209, which has descended to the surface of the transport path. When the tip of paper regulation lug 209 is pushed by sheets D, which have been inserted diagonally, clockwise torque acts on paper edge regulation element 207 centered on pivot 207*a*. At this time, paper edge regulation element 207 is pressed to rotate clockwise centered on pivot 207*a*. However, since another inner wall 207*b* that forms groove 208 touches rotation axis 206 of pickup roller 204 in its orbit, the rotation of paper edge regulation element 207 is regulated. As a result, the edges of sheets D that touch paper regulation lug 209 whose rotation is regulated are evened up.

When sheets D placed in paper feed tray 120 are fed, pickup roller 204 descends from the standby position until pickup roller 204 touches sheets D with a predetermined pressure. In this embodiment, when pickup roller 204 ascends to the standby position, a line segment connecting between rotation axis 301 of paper feed roller 205 and rotation axis 206 of pickup roller 204 is virtually parallel to the surface of sheets D placed in paper feed tray 120. As described above, pickup roller 204 (and rotation axis 206) rotates (descending operation) around rotation axis 301 of paper feed roller 205. Thus, in the process of rotation axis 206 of pickup roller 204 coming out of groove 208 of paper edge regulation element 207, rotation axis 206 of pickup roller 204 descends perpendicular to the surface of sheets D. Furthermore, groove 208 of paper edge regulation element 207 opens toward the surface of sheets D and fans out.

As a result, when pickup roller 204 descends from the standby position above to the pickup position, the inner wall that forms groove 208 does not interfere with the track of rotation axis 206 of pickup roller 204. Because of this, it is possible to smoothly lower pickup roller 204 even if sheets D are strongly pressed against paper regulation lug 209.

On the contrary, when rotation axis 206 of pickup roller 204 is placed above the plane including rotation axis 301 of paper feed roller 205, which is parallel to the surface of sheets D, the track of rotation axis 206 of pickup roller 204 includes the component of movement toward inner wall 207*b* that forms groove 208 of paper edge regulation element 207 in the initial stage of the descending operation. This promotes a pushing force that presses rotation axis 206 of pickup roller 204 to inner wall 207*b* of groove 208. As a result, it is impossible to smoothly lower pickup roller 204. This embodiment can prevent such inconvenience.

Figure 5A:
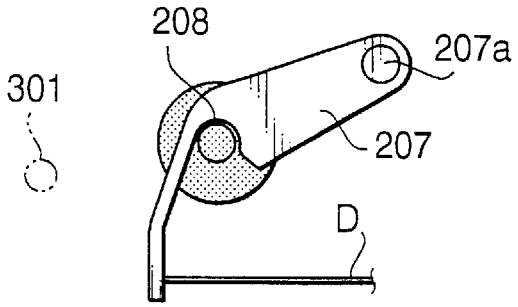
FIG. 5A is a first diagram to explain a state of stress that the paper edge regulation element receives from paper.

FIG. 5A shows a positional relationship between pivot 207*a* of paper edge regulation element 207, groove 208 of paper edge regulation element 207 and rotation axis 301 of paper feed roller 205 in this embodiment. As shown in the figure, pivot 207*a* of paper edge regulation element 207 is on the side opposite to groove 208 relative to paper feed roller 205.

Figure 5B:
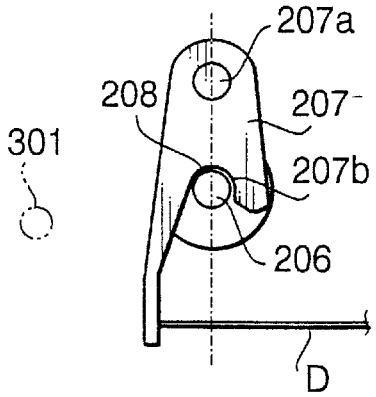
FIG. 5B is a second diagram to explain a state of stress that the paper edge regulation element receives from paper.

Suppose pivot 207*a* of paper edge regulation element 207 is closer to rotation axis 301 of paper feed roller 205 than groove 208 of paper edge regulation element 207. The pickup roller moves closer to the paper feed roller relative to the paper placement plane when the pickup roller descends and the inner wall on the paper regulation lug 209 that forms groove 208 is placed on the track of rotation axis 206 of pickup roller 204. Thus, the inner wall on the paper regulation lug 209 side becomes an obstacle making it impossible to lower pickup roller 204. As shown in FIG. 5B, when pivot 207*a* of paper edge regulation element 207 is placed right above groove 208 of paper edge regulation element 207, the inner wall on paper regulation lug 209 is no longer located on the track of rotation axis 206 of pickup roller 204. However, almost all components of the pushing force at the edges of sheets on paper regulation lug 209 become and act as a pushing force that inner wall 207*b* that forms groove 208 presses rotation axis 206 of pickup roller 204. This prevents pickup roller 204 from descending. In the case where pivot 207*a* of paper edge regulation element 207 is located on the right of groove 208 (opposite to rotation axis 301 of paper feed roller 205) as in the case of this embodiment, even if the edges of sheets press paper regulation lug 209 horizontally, this pushing force is broken down into a horizontal force and vertical force (upward). This can weaken the force with which the edges of sheets press paper regulation lug 209 horizontally and make it easier to let rotation axis 206 of pickup roller 204 come out of groove 208.

Furthermore, as shown in FIG. 5A, this embodiment places pivot 207*a* of paper edge regulation element 207 above groove 208 of paper edge regulation element 207. When rotation axis 206 of pickup roller 204 comes off groove 208 and sheets D press paper regulation lug 209, this allows a horizontal force (if any) to rotate paper edge regulation element 207. Thus, it is possible to alleviate load with which the edges of sheets press paper edge regulation element 207 and rotate paper edge regulation element 207 by the pushing force of sheets D alone without folding the edges of sheets.

Figure 5C:
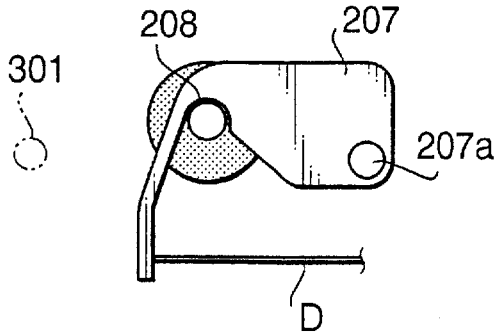
FIG. 5C is a third diagram to explain a state of stress that the paper edge regulation element receives from paper.

On the contrary, as shown in FIG. 5C, in the case where rotation axis 207*a* of paper edge regulation element 207 is located right next to groove 208 of paper edge regulation element 207, rotation axis 206 of pickup roller 204 comes off groove 208 and when sheets D are sent out by the rotation of pickup roller 204, paper edge regulation element 207 will not rotate unless a right upward force is applied to paper edge regulation element 207. Moreover, rotating paper edge regulation element 207 causes a great load producing inconvenience such that the edges of sheets are folded. This embodiment can prevent such inconvenience.

Next, a series of paper feeding operation by paper feed apparatus 200 above will be explained using the operation transition diagrams in FIG. 6 to FIG. 12 and the time chart in FIG. 13. When a start button is pressed while sheets are regulated as shown in FIG. 2, power is supplied to motor 400, which starts to drive and solenoid 411 makes planet gear 409 engage with paper feed roller gear 305, thus linking paper feed roller gear 305 with motor 400.

Figure 6:
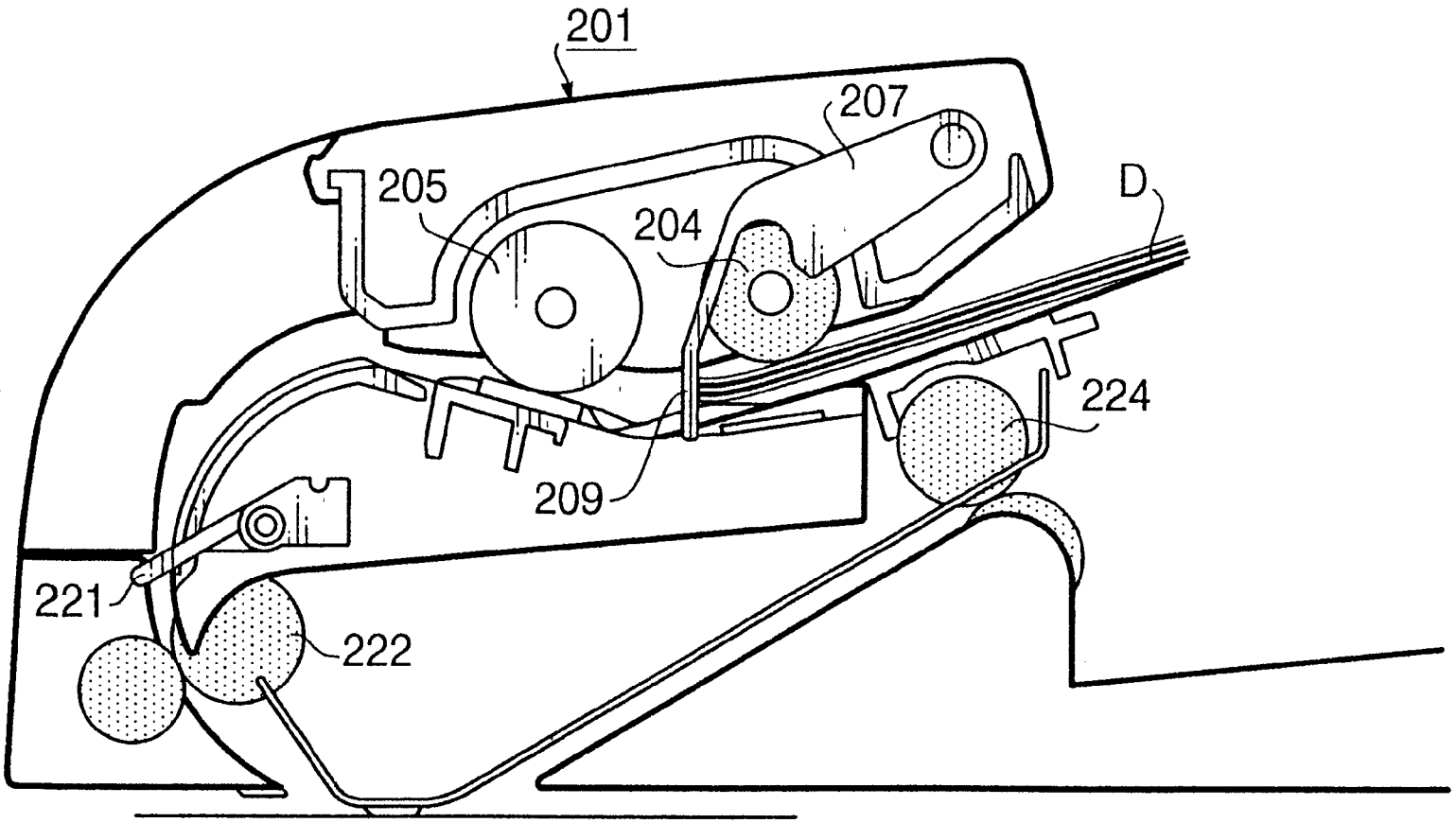
FIG. 6 illustrates a state of the paper feed apparatus above immediately after the pickup roller has descended.

When paper feed roller gear 305 rotates forward, coupling element 306 attached to rotation axis 301 of paper feed roller 205 rotates around rotation axis 301. As a result, rotation axis 206 of pickup roller 204 held to coupling element 306 in parallel to rotation axis 301 and pickup roller 204 descend. When pickup roller 204 descends, rotation axis 206 comes off groove 208 of paper edge regulation element 207. Pickup roller 204 that has descended touches sheets D. FIG. 6 shows a state in which pickup roller 204 that has descended has touched sheets D.

When pickup roller 204 touches sheets D, one-way clutch 307 between rotation axis 301 of paper feed roller 205 and coupling element 306 slides and pickup roller 204 is pressed to sheets D with an appropriate pushing force thereafter. On the other hand, rotation axis 301 of paper feed roller 205 continues to rotate and paper feed roller 205 starts to rotate forward and at the same time pickup roller 204 linked thereto via gears 310, 312 and 311 also starts to rotate forward.

Figure 7:
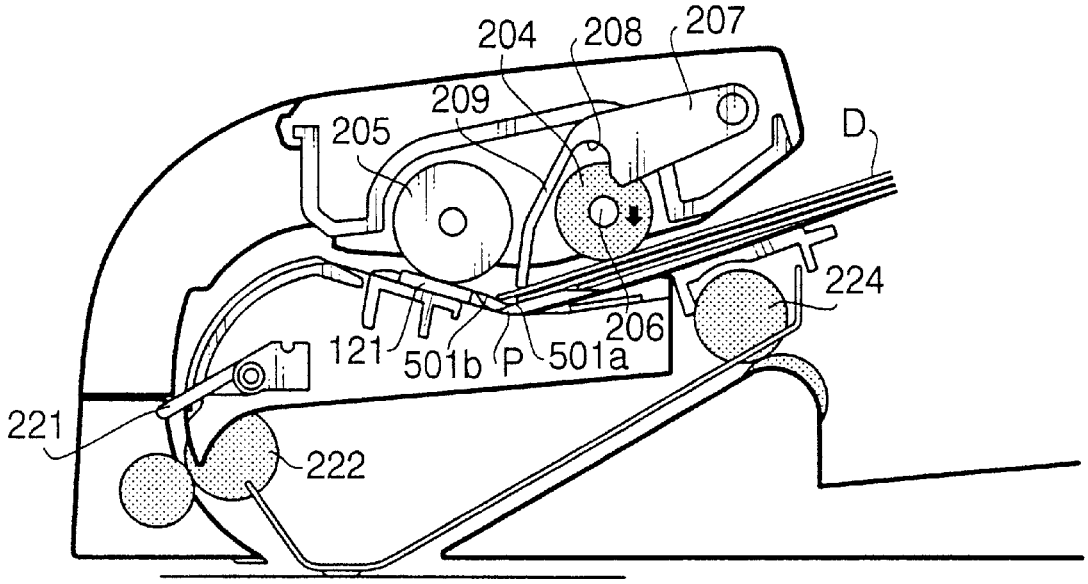
FIG. 7 illustrates a state of the paper feed apparatus above when the paper edge regulation element has been rotated by the edges of sheets.

When sheets D, which had been regulated by paper edge regulation element 207 until pickup roller 204 descended, start to be sent out by pickup roller 204, the pushing force of sheets D acts on paper regulation lug 209, which is now unlocked. This makes paper edge regulation element 207 rotate around pivot 207*a*. FIG. 7 shows a state in which sheets D sent out by pickup roller 204 have made paper edge regulation element 207 rotate around pivot 207*a* and sheet D1 has just passed beneath paper regulation lug 209.

As shown above, rotation axis 206 of pickup roller 204 fits into groove 208 of paper edge regulation element 207 and rotation axis 206 of pickup roller 204 alone regulates the rotation of paper edge regulation element 207, and when pickup roller 204 descends and rotation axis 206 of pickup roller 204 comes off groove 208, paper edge regulation element 207 becomes free to rotate. This makes it possible to take advantage of a pushing force of sheets D sent out by the rotation of pickup roller 204 that has descended to rotate paper edge regulation element 207. Thus, paper edge regulation element 207 can be moved to a place out of the way of paper feeding with such an extremely simple configuration.

Here, the embodiment above adopts a configuration setting sheets of paper on standby with the top sheet inclined backward and lower sheets inclined forward and separation pad 212 placed beneath the lowest sheet. Thus, sheets are set on standby with the sheet touching pickup roller 204 sent out backward and the sheet beneath the top sheet coming out forward. As a result, when pickup roller 204 sends out sheets, the sheet beneath the sheet touching pickup roller 204 is likely to reach separation pad 212 before the sheet touching pickup roller 204, causing double-sheet feeding.

Thus, an oblique depressed surface is formed on the transport path connecting separation pad 211 and the standby position of sheets. Paper feed apparatus 200 shown in FIG. 7 forms downward inclined plane 501*a* and upward inclined plane 501*b* with point P as a boundary on the transport path connecting separation pad 212 and the standby position of sheets.

As shown above, since inclined planes 501*a* and 501*b* constituting a cavity are formed, even if two sheets are sent out together with the sheet beneath the sheet that touches pickup roller 204 going ahead, the lower sheet touches upward inclined plane 501*b* first, which prevents the lower sheet from going forward, thus allowing the top sheet directly sent out by pickup roller 204 to reach separation pad 212 first. As a result, it is possible to prevent double-sheet feeding of paper with a simple configuration.

Next, sheet D1 sent out by pickup roller 204 that has descended is handed over to paper feed roller 205. When sheet D1 is transported through the transport path by the rotation of paper feed roller 205, the edge of the sheet kicks register sensor 221. When the front end of sheet D1 arrives at the position of register sensor 221, the rear end of sheet D1 has not passed through the position of regulation by paper edge regulation element 207. When sheet D1 fed by paper feed roller 205 arrives at register roller 222, the rotation of paper feed roller 205 must be stopped to prevent sheet D1 from bending due to a difference between the rotational speed of register roller 222 and the rotational speed of paper feed roller 205. For this reason, as shown in FIG. 13, when register sensor 221 detects the front end of sheet D1, the rotation of motor 400 is stopped after a lapse of predetermined time T1. Time T1 is the time after register sensor 221 detects the front end of the sheet until the front end of the sheet arrives at register roller 222. Then, solenoid 411 is controlled to separate planet gear 409 from paper feed roller gear 305. Sheet D1 is pulled by register roller 222, but paper feed roller 205 stays idling by one-way clutch 304, and therefore sheet D1 is transported smoothly.

On the other hand, when the linkage between planet gear 409 and paper feed roller gear 305 is cut, paper feed roller gear 305 becomes free. Then, the restitutive force of coil spring 314 makes coupling element 306 rotate around rotation axis 301 of paper feed roller 205 in the direction in which pickup roller 204 (and rotation axis 206) ascends.

Figure 8:
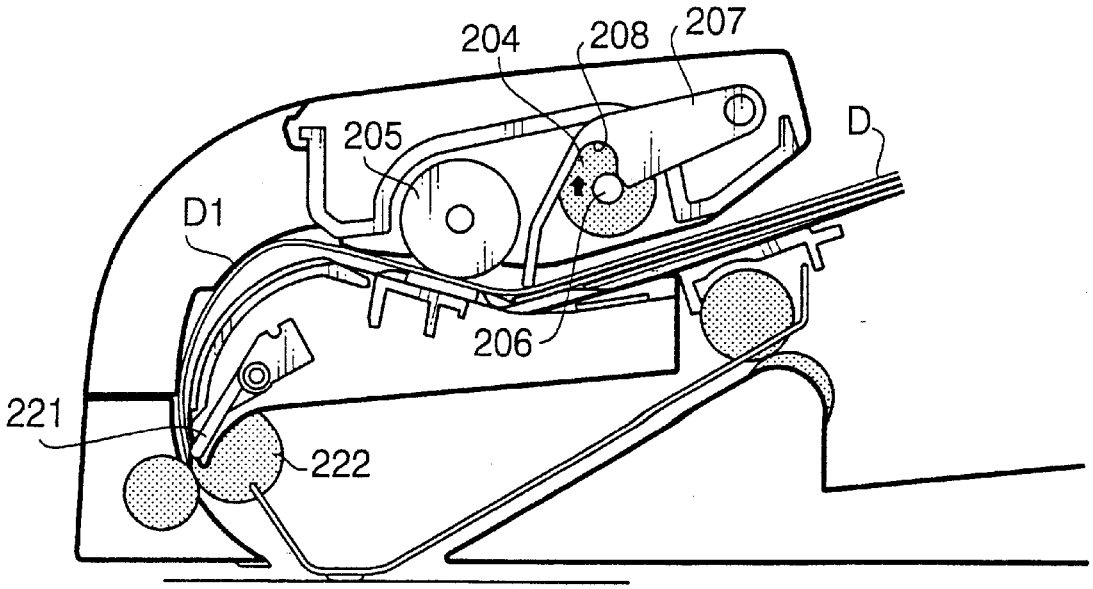
FIG. 8 illustrates a state of the paper feed apparatus above immediately after the edge of a first sheet of paper has been detected by the register roller sensor.

Here, for the purpose of reducing the size of the apparatus, the distance between register roller 222 and paper feed roller 205 is such that when the front end of the sheet arrives at register roller 222, the rear end of the sheet has not passed beneath paper feed roller 205 yet. Therefore, before the rear end of sheet D1 passes beneath the edge of paper feed regulation lug 209, pickup roller 204 (and rotation axis 206) ascends. Before the rear end of the sheet passes beneath the edge of paper feed regulation lug 209, the sheet remains pushing up paper edge regulation element 207. Therefore, the direction in which groove 208 of paper edge regulation element 207 opens is inclined deviated from rotation axis 206 of pickup roller 204. Thus, rotation axis 206 of pickup roller 204 that has ascended does not fit into groove 208 of paper edge regulation element 207. FIG. 8 shows a state in which the edge of sheet D1 is detected by register roller sensor 221 and rotation axis 206 of pickup roller 204 ascends to a position at which rotation axis 206 interferes with the opining of groove 208 of paper edge regulation element 207.

Figure 9:
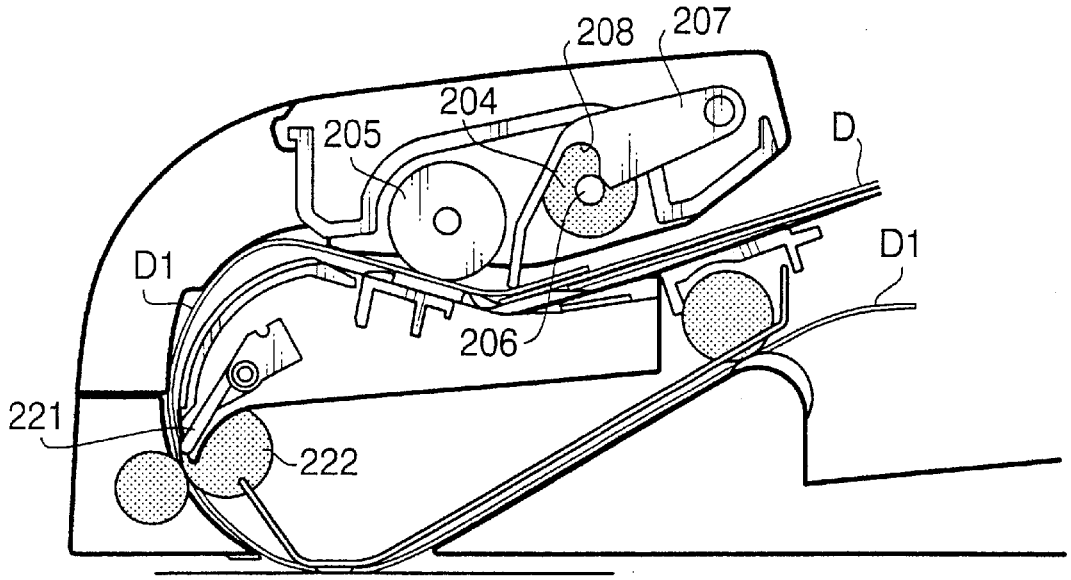
FIG. 9 illustrates a state of the paper feed apparatus above when the edge of the first sheet of paper has been ejected out of the paper feed apparatus.
Figure 13:
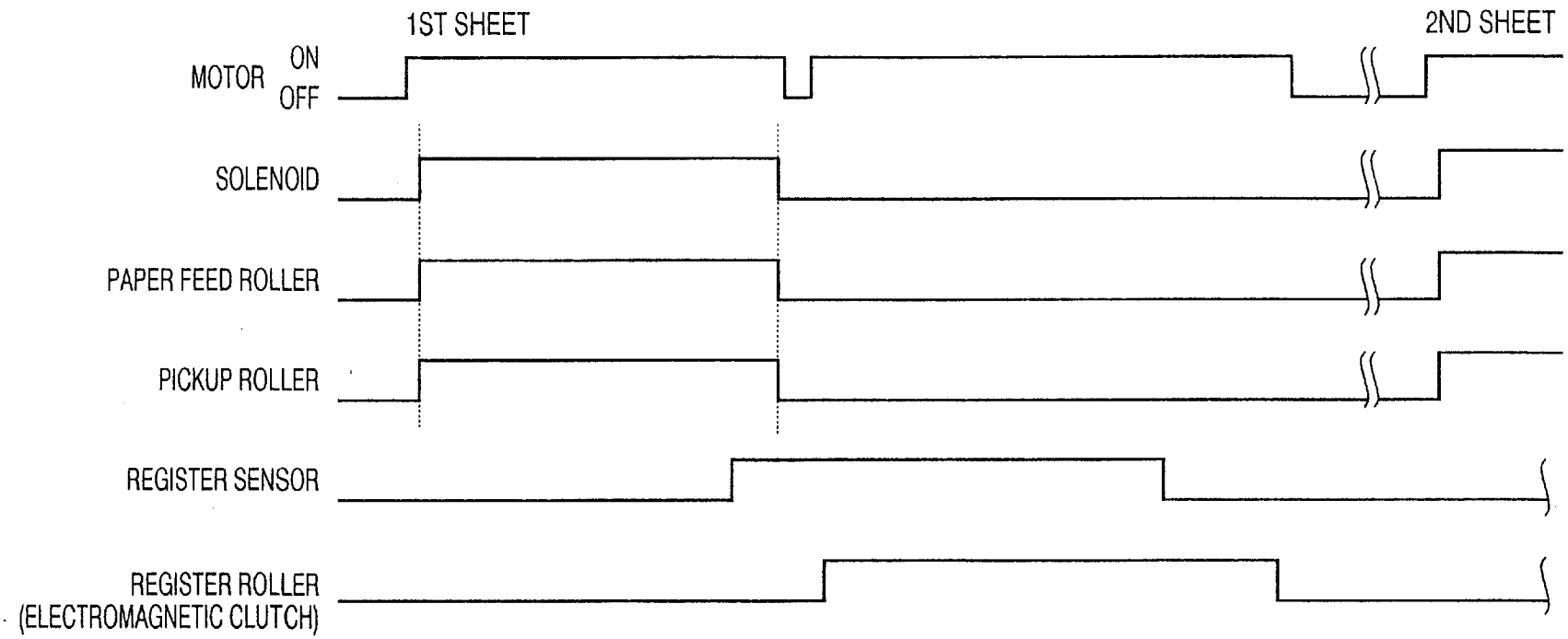
FIG. 13 shows a time chart of the paper feeding operation of the paper feed apparatus above.

As shown if FIG. 13, the rotation of motor 400 is temporarily stopped after a lapse of predetermined time T1 after the edge of sheet D1 is detected by register roller sensor 221. Immediately after the rotation of motor 400 is temporarily stopped, the rotation axis of motor 400 and register roller gear 412 are linked by an electromagnetic clutch. When motor 400 starts driving after motor 400 is linked with register roller 222, register roller 222 rotates and sheet D1 is transported toward ejection roller 224. FIG. 9 shows a state in which the front end of sheet D1 has been ejected outside the paper feed apparatus by ejection roller 224.

When the rear end of first sheet D1 is detected by register roller sensor 221, the rotation of motor 400 is stopped after a lapse of predetermined time T2. Time T2 corresponds to the time after the rear end of the sheet is detected by register roller sensor 221 until the rear end of the sheet passes beneath register roller 222. Sheet D1 whose rear end has been detected by register roller sensor 221 passes through the scanning position and is ejected upward into ejection tray 101*a* by ejection roller 224.

When feeding of first sheet D1 is completed as described above, the feeding operation of the second sheet is started. That is, motor 400 is linked with paper feed roller gear 305 to lower pickup roller 204 and send out the sheet. In feeding of the second and subsequent sheets, rotation axis 206 of pickup roller 204 descends from the position at which rotation axis 206 of pickup roller 204 has not fitted into groove 208 of paper edge regulation element 207 (FIG. 8 and FIG. 9), touches and sends out the sheet. Then, when register roller sensor 221 detects the front end of the sheet, motor 400 is temporarily stopped, linked with register roller gear 412, then rotated, and the sheet is passed through the scanning position and then ejected.

When the last sheet of sheets D placed in paper feed tray 120 is sent out, placement detection sensor 315 is no longer pushed out of the transport path by the sheet placed, that is, the placement detection sensor 315 is set to an OFF position, and it is decided that the sheet currently being sent out is the final sheet and the resetting operation of paper edge regulation element 207 is started.

Figure 10:
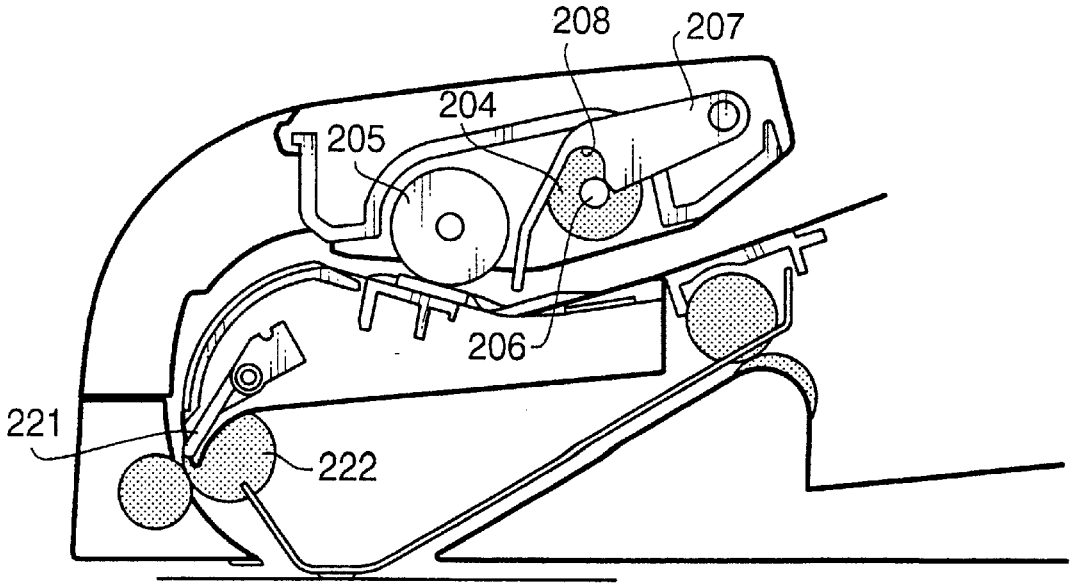
FIG. 10 illustrates a state of the paper feed apparatus above immediately after the last sheet of paper has been ejected.

As described above, on and after the second sheet, when rotation axis 206 of pickup roller 204 comes off groove 208 of paper edge regulation element 207, rotation axis 206 of pickup roller 204 does not fit into groove 208 of paper edge regulation element 207. For this reason, paper edge regulation element 207 does not function as the stopper. FIG. 10 shows the relationship between paper edge regulation element 207 and pickup roller 204 after the last sheet is sent out.

Figure 11:
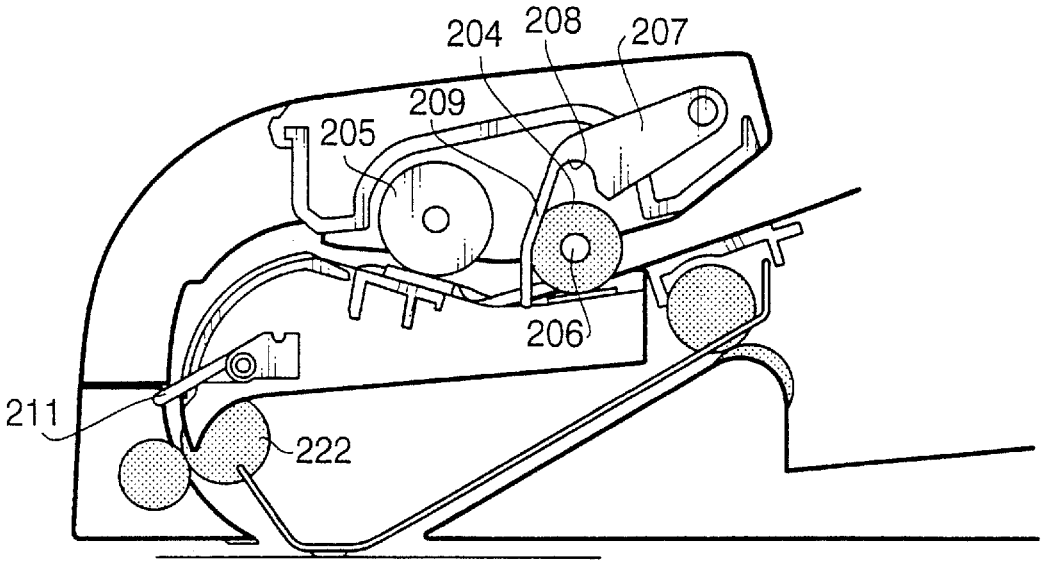
FIG. 11 illustrates a state of the paper feed apparatus above when the pickup roller has been lowered after ejection of the last sheet of paper.
Figure 12:
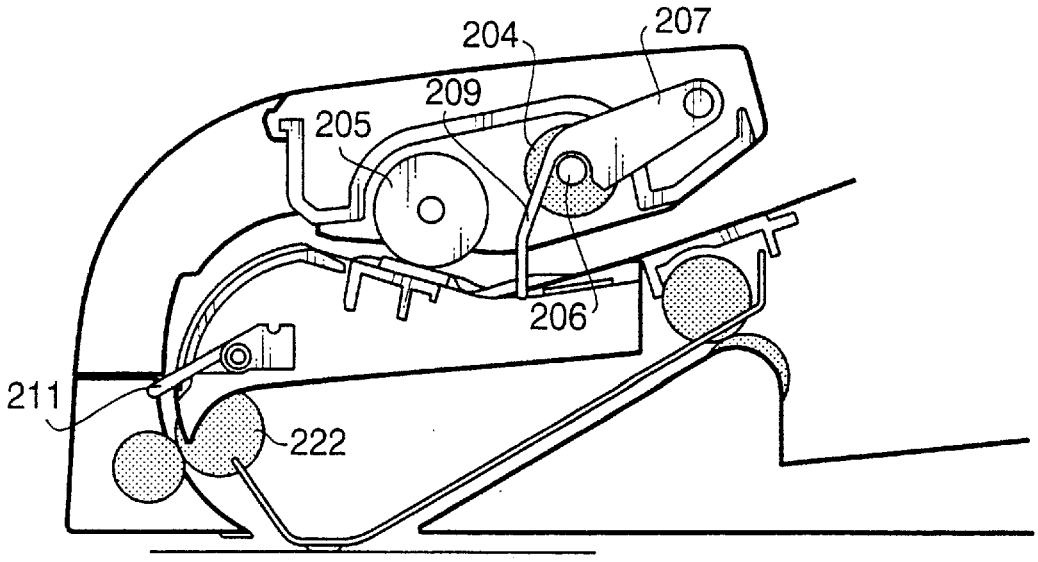
FIG. 12 illustrates a state of the paper feed apparatus above when the rotation axis of the pickup roller has entered into the groove of the paper edge regulation apparatus after ejection of the last sheet of paper.

According to this embodiment, when the sheet currently being sent out is the final sheet, pickup roller 204, which is ascending after the last sheet is sent out is lowered again. After the last sheet is sent out, the sheet that has been pushing up paper edge regulation element 207 so far is no longer there. Therefore, paper edge regulation element 207 descends until the edge of paper regulation lug 209 touches the surface of the transport path together with pickup roller 204 that descends to the transport path. FIG. 11 shows a state in which after the last sheet is sent out, pickup roller 204 is lowered to the transport path. As shown in the figure, when pickup roller 204 and paper edge regulation element 207 are completely lowered, the direction in which groove 208 of paper edge regulation element 207 opens mostly coincides with the track of rotation axis 206 of pickup roller 204. In this way, when pickup roller 204 is lifted again, rotation axis 206 fits into groove 208 of paper edge regulation element 207, which is located in the orbit. Moreover, the opening of groove 208 fans out toward rotation axis 206 of pickup roller 204, and therefore rotation axis 206 of pickup roller 204 can smoothly fit into groove 208. FIG. 12 shows a state in which after the last sheet is sent out, rotation axis 206 of pickup roller 204 has fitted into groove 208 of paper edge regulation element 207. After the final sheet is sent out, rotation axis 206 of pickup roller 204 fits into groove 208 of paper edge regulation element 207. This allows paper edge regulation element 207 to function again as the stopper to even up the edges of sheets to be placed in paper feed tray 120.

As described above, according to this embodiment, it is possible to regulate and release the edges of sheets placed by simply lifting or lowering pickup roller 204. This eliminates the need to provide a separate mechanism to drive paper edge regulation element 207, making it possible to simplify the structure and save the space inside the apparatus.

Moreover, when pickup roller 204 descends, paper edge regulation element 207 becomes free to rotate. This allows pickup roller 204 to rotate and send out sheets and press paper edge regulation element 207, thus making paper edge regulation element 207 itself rotate. This also makes it possible to synchronize the ascending/descending operation of pickup roller 204 with the regulation/release of the edges of sheets by paper edge regulation element 207.

Figure 14:
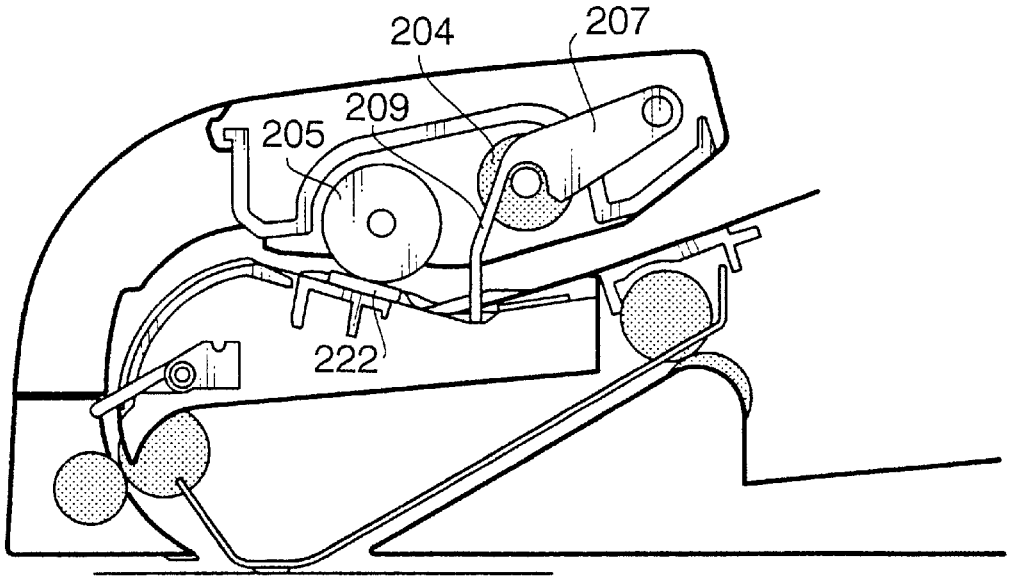
FIG. 14 illustrates a modification example of the paper feed apparatus above when a cavity has been formed in the transport path between the paper regulation position and separation section.
Figure 15:
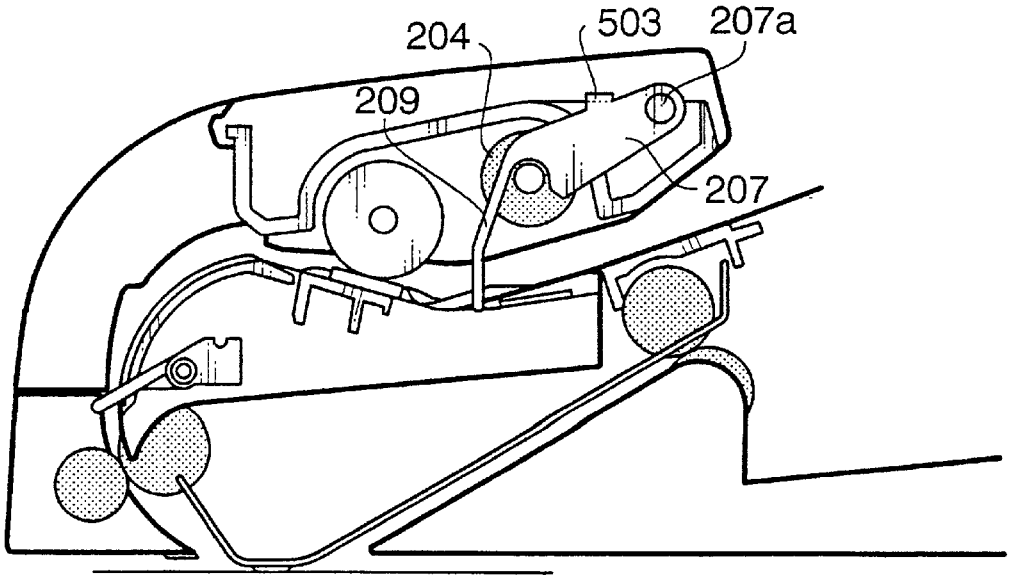
FIG. 15 illustrates a modification example of the paper feed apparatus above provided with an engagement section that stops the paper edge regulation element at a predetermined rotation angle.
Figure 16A:
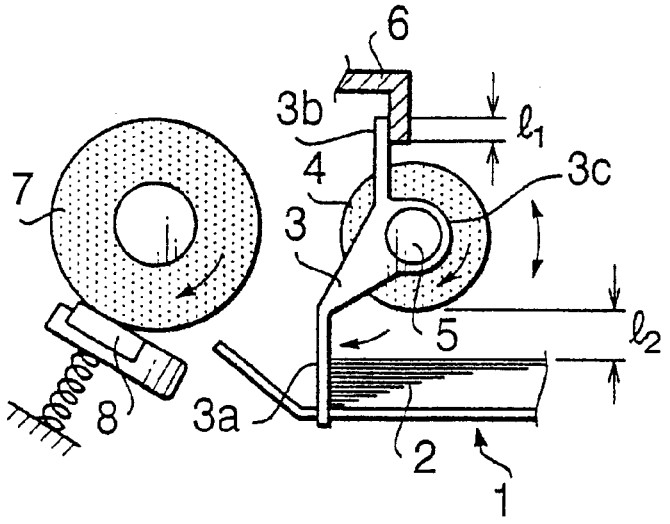
FIG. 16A PRIOR ART
FIG. 16A is a configuration diagram showing a first state of a conventional paper edge regulation mechanism.
Figure 16B:
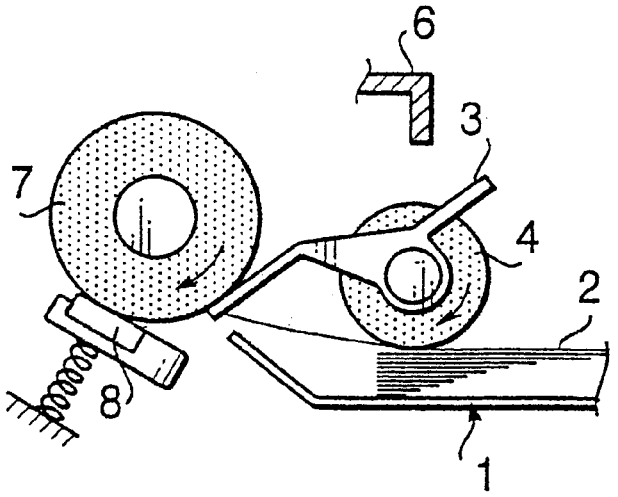
FIG. 16B PRIOR ART
FIG. 16B is a configuration diagram showing a second state of the conventional paper edge regulation mechanism.

It is desirable that the angle of paper edge regulation element 207 during paper edge regulation be an angle that paper edge regulation element 207 can easily rotate by the pushing force of sheets when rotation axis 206 of pickup roller 204 comes off groove 208 of paper edge regulation element 207. In this case, as shown in FIG. 14, a cavity is formed on the transport path and it is possible to obtain an optimal angle by making the edge of paper regulation lug 209 touch this cavity. Or, as shown in FIG. 15, it is also possible to form engagement section 503 that protrudes horizontally on the back of paper edge regulation element 207 and make this engagement section 503 engage with the fixing section of frame 202 at an optimal angle of paper edge regulation element 207.

When rotation axis 206 of pickup roller 204 comes off groove 208 of paper edge regulation element 207, this allows paper edge regulation element 207 to stop at a predetermined rotation angle. This allows paper edge regulation element 207 to stay on standby at a position where paper edge regulation element 207 can be rotated only by a pushing force with which sheets sent out by the rotation of pickup roller 204 push paper edge regulation element 207. This prevents the weight of paper edge regulation element 207 from being a load more than necessary, making it possible to smoothly feed sheets.

The above embodiment describes the case where paper feed apparatus 200 is applied to a copier, but the present invention can also be applied to other devices that feed placed sheets such as a printer and scanner with a paper feeding function.

The present invention is not limited to the above described embodiments, and various variations and modifications may be possible without departing from the scope of the present invention.

This application is based on the Japanese Patent Application No. HEI 11-353263 filed on Dec. 13, 1999, entire content of which is expressly incorporated by reference herein.

What is claimed is:

1. A paper feed apparatus comprising:

a pickup roller which is provided above sheets so that said pickup roller is free to ascend/descend on a pivot, and which touches an upper surface of said sheets and sends out said sheets when said pickup roller descends;

a paper feed roller that sends a sheet sent out by said pickup roller to a transport path; and a paper edge regulation element that has a pivot different from said pivot of said pickup roller and a groove which regulates a rotation of said paper edge regulation element when said pickup roller ascends and a rotation axis of said pickup roller fits into said groove, and said paper edge regulation element evens up edges of said sheets, wherein said paper edge regulation element evens up edges of said sheets, in case where said rotation of said paper edge regulation element is regulated when said pickup roller ascends and a rotation axis of said pickup roller fits into said groove.

2. The paper feed apparatus according to claim 1, wherein said paper edge regulation element becomes free to rotate when the pickup roller descends and the rotation axis of said pickup roller comes off said groove, and rotates by a pushing force with which the sheets, which are sent out by the rotation of said pickup roller, push said paper edge regulation element.

3. The paper feed apparatus according to claim 1, wherein the pivot of said paper edge regulation element is provided on a side opposite to the groove of said paper edge regulation element with respect to said paper feed roller.

4. The paper feed apparatus according to claim 1, wherein the pivot of said paper edge regulation element is provided above the groove of said paper edge regulation element.

5. The paper feed apparatus according to claim 1, further comprising:

an engagement part that stops said paper edge regulation element at a predetermined rotation angle, in case where said paper edge regulation element has been set free to rotate when the rotation axis of said pickup roller comes off said groove.

6. The paper feed apparatus according to claim 1, further comprising:

an inclined guide part which is provided at a position downstream of transporting of placed sheets from said paper edge regulation element, and which guides sheets upward toward a paper regulation surface of said paper edge regulation element.

7. The paper feed apparatus according to claim 1, wherein the groove of said paper edge regulation element which has a diameter greater than a diameter of the rotation axis of said pickup roller and fans out in a direction in which the rotation axis comes out of the groove.

8. The paper feed apparatus according to claim 5, wherein said paper edge regulation element has a sheet regulation plane inclined so that an upper sheet is placed at a position upstream of transporting of placed sheets from a lower sheet, when said rotation axis of said pickup roller fits into said groove.

9. The paper feed apparatus according to claim 8, further comprising:

a separator which is provided at a position downstream of transporting path for placed sheets, and said separator touches the bottom face of a sheet transported and separates one sheet at a time;

an inclined plane which is provided at a position downstream on said transporting path, said position being between a standby position of sheets and said separator and which goes up from said standby position of sheets to said position and said separator and goes down from said position toward said separator.

10. A paper feed apparatus comprising:

a pickup roller that is provided above sheets such that said pickup roller is free to ascend/descend on a pivot and that touches the upper surface of said sheets and sends out said sheets when said a pickup roller descends;

a paper feed roller that sends the sheet sent out by said pickup roller to a transport path; and a paper edge regulation element that has a pivot different from said pivot of said pickup roller and a groove which regulates a rotation of said paper edge regulation element when said pickup roller ascends and a rotation axis of said pickup roller fits into said groove, and said paper edge regulation element evens up edges of said sheets, wherein said groove is formed so that said rotation axis of said pickup roller fits into said groove to a position where a plane including the pivot of said pickup roller and the rotation axis of said pick up roller becomes parallel to a sheet placement plane, and said paper edge regulation element evens up edges of said sheets, in case where said rotation of said paper edge regulation element regulated when said pickup roller ascends and a rotation axis of said pickup roller fits into said groove.

11. A paper feed apparatus comprising:

a driving source;

a pickup roller that is provided above sheets such that said pickup roller is free to ascend/descend on a pivot, and that touches the upper surface of said sheets and sends out said sheets when said a pickup roller is descended by torque transmitted from said driving source;

a paper feed roller that sends the sheet sent out by said pickup roller to a transport path;

a paper edge regulation element that has a pivot different from said pivot of said pickup roller and a groove which regulates a rotation of said paper edge regulation element when said pickup roller ascends and a rotation axis of said pickup roller fits into said groove, and said paper edge regulation element evens up edges of said sheets in case where said rotation of said paper edge regulation element regulated when said pickup roller ascends and a rotation axis of said pickup roller fits into said groove; and.

a drive controller that cuts transmission of torque to said pickup roller and lifts said pickup roller, before a rear end of a sheet currently being sent out passes beneath said paper edge regulation element, wherein said drive controller ascends said pickup roller, and descends said pickup roller, and then ascends said pickup roller, when the sheet currently being sent out is a final sheet.

12. A copier comprising:

an image scanning section that scans a document image;

the paper feed apparatus according to claim 1; and an image formation section that forms the image scanned by said image scanning section on a sheet fed by said paper feed apparatus.

* * * * *